United States Patent [19]

Bland et al.

[11] Patent Number: 4,462,016

[45] Date of Patent: Jul. 24, 1984

[54] INDUCTOR COILS WITH MECHANICALLY COUPLEABLE BOBBINS

[75] Inventors: Randall J. Bland; Ronald W. Butler; Samuel F. Horton, all of Shreveport, La.

[73] Assignee: AT&T Technologies, Inc., New York, N.Y.

[21] Appl. No.: 446,310

[22] Filed: Dec. 3, 1982

[51] Int. Cl.[3] ..... H01F 15/10; H01F 27/30

[52] U.S. Cl. ..... 336/192; 242/118.41; 336/208

[58] Field of Search ..... 336/198, 208, 192; 242/118.41, 118.4; 310/194, 71

[56] References Cited

U.S. PATENT DOCUMENTS

| | | | |
|---|---|---|---|
| 358,705 | 3/1887 | Smith | 242/118.41 |
| 2,636,695 | 4/1953 | Bixby | 242/118.41 |
| 2,781,986 | 2/1957 | Bixby | 242/118.41 |
| 3,271,760 | 9/1966 | Sloan | 336/192 X |
| 3,315,198 | 4/1967 | Biesma et al. | 336/208 X |
| 3,328,736 | 6/1967 | Keck | 336/208 X |
| 3,343,113 | 9/1967 | Dougall | 36/192 |
| 3,423,711 | 1/1969 | Woods et al. | 336/192 |
| 3,434,088 | 3/1969 | Zieles | 336/208 X |
| 3,555,477 | 1/1971 | Hildebrandt | 336/192 |
| 3,689,862 | 9/1972 | Hilgers | 336/208 |
| 4,166,265 | 8/1979 | Reynolds et al. | 336/192 |
| 4,318,069 | 3/1982 | Morse | 336/198 X |

FOREIGN PATENT DOCUMENTS

| | | | |
|---|---|---|---|
| 2035957 | 11/1978 | United Kingdom | 242/118.4 |

*Primary Examiner*—Thomas J. Kozma
*Attorney, Agent, or Firm*—R. F. Kip, Jr.

[57] ABSTRACT

An inductor coil comprises a main winding of insulated wire on the barrel of a bobbin having two axial lugs salient from one of the bobbin's end flanges, and having two recesses formed in the outer surface of the other of such flanges. A coaxial array of such bobbins is mounted on a rotatable spindle axially salient from a rotatable driving head such that the bobbins are, by such lugs and recesses, mechanically coupled together and to said head. The head is rotated to produce through such lugs and recesses a rotation of such bobbins utilized to form such main windings thereon. The lugs of each such bobbin supported elongated plastic arms having bifurcated outer ends around which are formed wire windings providing terminals for the main winding of the coil.

6 Claims, 6 Drawing Figures

INDUCTOR COILS WITH MECHANICALLY COUPLEABLE BOBBINS

TECHNICAL FIELD

This invention relates generally to inductor coils and, more particularly, to coils of such kind which comprise wire windings on bobbins of insulated material, and the bobbins of which are mechanically coupleable together to be mutually coupled for purposes of common rotational movement.

BACKGROUND OF THE INVENTION

U.S. Pat. No. 3,689,862 to Hilgers discloses inductor coils with mechanically coupleable bobbins in which the bobbin of each coil comprises a tubular barrel, larger and smaller end flanges on axially opposite ends of the barrel and rendering the bore closed and open at its larger and smaller flange ends, a raised non-circular rib on the outside of the larger flange and enclosing a region matching the configuration of the smaller flange, and a pin coaxial with and projecting from the larger flange and of slightly smaller size than the bore of the barrel. In use, two or more similar bobbins are placed coaxially to form a bobbin array in which, say, the pins of the bobbins extend leftward. The bobbins in the array are then assembled by inserting each bobbin pin having a bobbin to its left into the base of the leftward bobbin, and by inserting the small flange of each bobbin having one to its right into the region enclosed by the raised rib on the rightward bobbin. When so assembled, the bobbins in the array are coupled for common rotation. The Hilgers patent discloses that inductance coils can then be formed by rotating the bobbins together (by undisclosed means) to cause individual wires to be wound as coils on the bobbins in the array.

The inductor coils of the Hilgers patent have the disadvantages among others that their pins are, upon separation of the bobbins, superfluous and wasteful of material and space and can create problems in mounting the inductor coils other than in the stacked relation taught by Hilgers. Moreover, the mode of coupling the bobbins together by having the entire smaller flange of one bobbin received within a region enclosed by the raised rib on the larger flange of another is wasteful of bobbin material. A further disadvantage is that, when an array of the Hilgers bobbins are assembled as described, the bobbins are maintained in angular alignment only by the closeness of fit between their assembled pins and bores but, if there is any angular play therebetween, such play accumulates over the array of bobbins as a function of their number. The result is that the number of bobbins which can be included in such an array without exceeding a limit for angular play per bobbin which is prescribed in connection with, say, the winding of wires individually on the bobbins is a number which is inherently restricted.

SUMMARY OF THE INVENTION

Those disadvantages of the Hilgers coils are obviated according to the invention in one of its aspects by providing inductor coils each comprising a bobbin having a tubular barrel with a substantially circular cylindrical bore extending axially entirely through the bobbin, radial end flanges on opposite ends of the barrel, and coupling elements in the form of one or more lugs and one or more recesses provided on, respectively, such two flanges and adapted by lug-into-recess insertions to couple a coaxial array of such bobbins with each other and with a driving head when such array is mounted on a spindle extending from such head. Rotation of the head will then produce common rotation in fixed relation of the bobbins by their lug-recess couplings to enable them to wind on their barrels respective windings constituting other respective parts of the described coils.

According to the invention in another of its aspects, the inductor coils may each be provided with at least two lugs and recesses as described for mechanically coupling the bobbins of the coils together, and such lugs of each coil may serve as respective mountings for at least two elongated radial arms providing thereon terminal regions for the coil winding and coupled at their inner ends to the corresponding lugs to be supported as cantilevers therefrom. Still further aspects of the invention are that such arms may be integral with and of the same material as the bobbin, with such terminal regions being provided by wire windings on the outer ends of the arms, and that such outer ends may be bifurcated in a manner whereby the terminal winding on each such end spans the gap between the two tines of the forked end.

BRIEF DESCRIPTION OF DRAWINGS

For a better understanding of the invention, reference is made to the following description of an exemplary embodiment thereof, and to the accompanying drawings wherein.

DESCRIPTION OF EMBODIMENT

Figure 1:
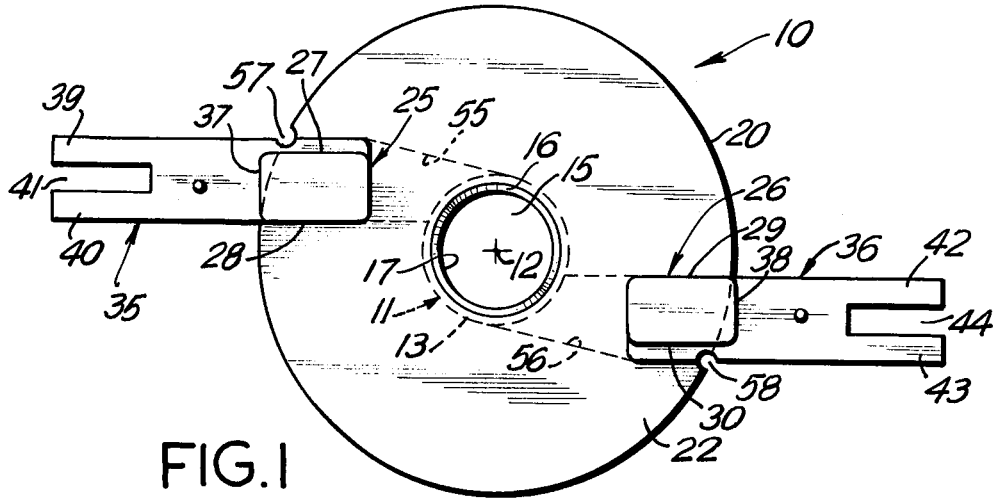
FIG. 1 is a plan view of the bobbin of such embodiment.
Figure 2:
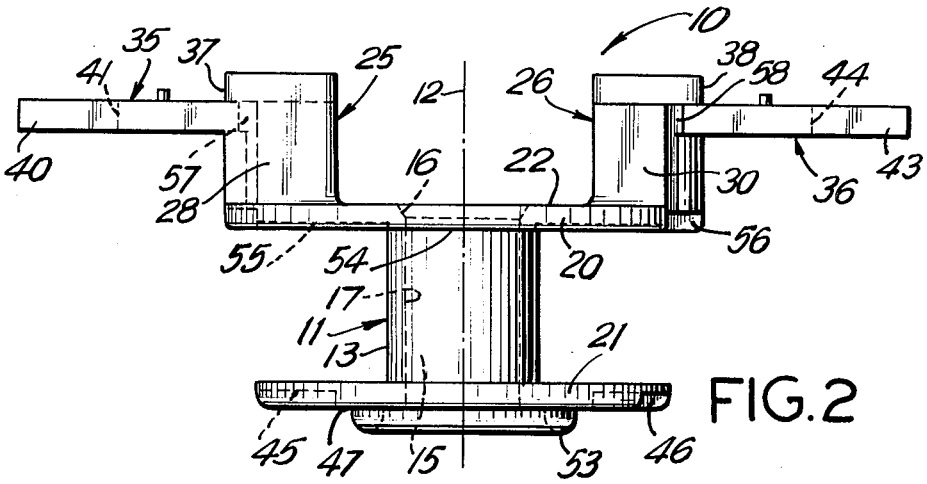
FIG. 2 is a front elevation of the FIG. 1 bobbin.
Figure 3:
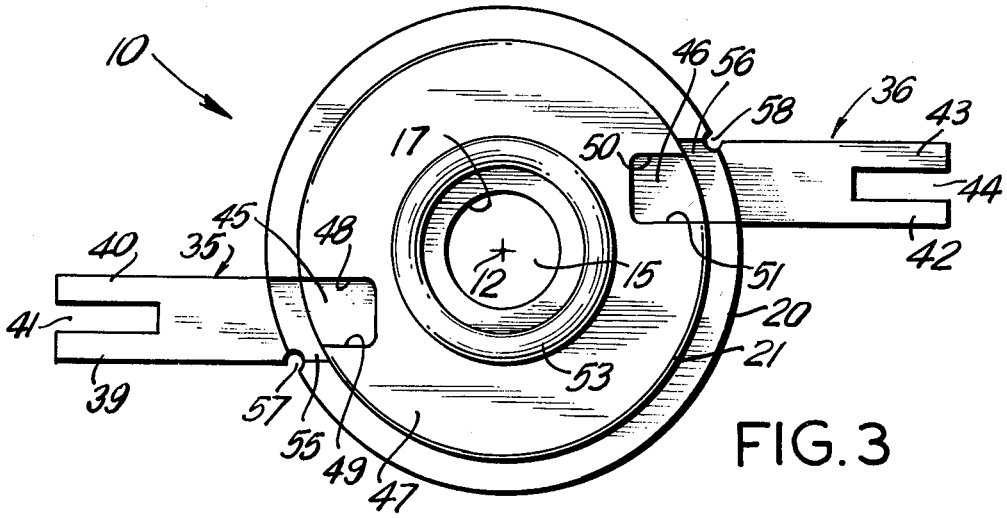
FIG. 3 is a bottom view of the FIG. 1 bobbin.

Referring to FIGS. 1–3, the reference numeral 10 designates an inductor coil bobbin formed by plastic molding and constituted of a thermoplastic insulating material as for example a mixture by weight of 67% nylon "6/12" and 33% fiberglass. Bobbin 10 includes as an integral part thereof a tubular barrel 11 having a central longitudinal axis 12, a circular cylindrical outer surface 13 and an axial interior bore 15 traversing the bobbin from end to end to provide a passage entirely therethrough. Bore 15 at its upper end (FIG. 2) is slightly enlarged radially by fairing so as to have an outward flaring 16, but the bore over the remainder (i.e., the majority) of its length is of substantially constant circular cross-section in planes normal to its axis 12. Since bore 15 has no keyways or like indentations formed in its interior bounding wall 17, the radial thickness of barrel 11 may be made of minimum thickness (consonant with supporting thereon (as later described) the main winding of the inductor coil) so as, thereby, to conserve bobbin material.

Disposed at axially opposite ends of barrel 11 are front and back end flanges 20 and 21 integral with bobbin 10 and preferably (but not necessarily) of circular annular configuration. As shown, flange 21 is radially somewhat smaller than flange 20, but, if desired, the two flanges may be of the same diameter.

Projecting axially outward from the outer surface 22 of front flange 20 are two lugs 25, 26 which conveniently (but not necessarily) are in the form of stub posts, and which have such relative angular spacing and respective radial spacings from axis 12 as to be disposed at the periphery of flange 20 on diametrically opposite sides of such axis. Lugs 25, 26 are preferably integral with bobbin 10 and have angularly spaced sides 27, 28 (for lug 25) and 29, 30 (for lug 26) lying in planes parallel to axis 12 in the sense that such axis is parallel to lines in each of such planes.

Lugs 25, 26 respectively support as cantilevers a pair of elongated terminal arms 35, 36 joined at their inner ends to these lugs intermediate in their axial lengths between their bases and their free ends such that the lugs have tips 37, 38 projecting axially outward of the arms, such tips having a somewhat smaller width than the parts lying below them of the lugs. As shown, the arms 35, 36 extend outward beyond the periphery of flange 20 in a plane normal to axis 12, such extension of the arms being primarily radial in relation to that axis but having also a tangential component. If desired arms 35, 36 may extend wholly radially. Also, if desired, arms 35, 36 may be in the form of elongated rectangular electroconductive metal inserts of which the free ends are molded or inserted into the insulating material of lugs 25, 26 to be supported thereby as cantilevers. In order, however, to avoid the need for such extra parts and the extra operation of assembling such metal inserts into the mold for the bobbin 10, it is preferable that, as shown, arms 35, 36 be constituted of the same insulating material as bobbin 10 and be integral with the lugs 25, 26.

The arms 35, 36 have bifurcated outer ends so as to be constituted (for arm 35) of two radially extending tines 39, 40 angularly spaced by a gap 41 and (for arm 36) two similar radially extending tines 42, 43 angularly spaced by a gap 44. The reason for having such bifurcated ends is discussed hereinafter.

Turning now to flange 21, such flange has formed therein a pair of recesses 45, 46 extending axially inward from the outer surface 47 of the flange and having the same angular spacing from each other and radial spacings from axis 12 as do the lugs 25, 26, the recesses desirably being placed so that they axially register with lugs 25, 26. In order that such recesses may be as close as possible to the periphery of flange 21, they preferably take the form of notches extending inward from such periphery primarily radially but with a tangential component. Notches 45, 46 are of rectangular cross section normal to their centerlines and have opposite planar sides 48, 49 (for notch 45) and 50, 51 (for notch 46) which are parallel to the opposite planar sides 27, 28 and 29, 30 of, respectively, lugs 25, 26. The notch sides have, however, slightly greater radial extent and a slightly greater spacing from each other than such opposite sides of such lugs. Hence, the notches 45, 46 of bobbin 10 are adapted to receive therein with a close fit the lug tips of a similar bobbin. Note that the notches 45, 46 have an axial depth great enough to accomodate most or all of the axial extent of the lugs tips of the other bobbin, but, at the same time, not so great that notches 45, 46 pass entirely through the axial thickness of flange 21.

The outer surface 47 of back flange 21 has thereon an annular bead 53 of a radius less than the radial spacing of lugs 25, 26 such that the bead will fit between the lugs of another bobbin when the two bobbins are coaxially juxtaposed.

Returning to front flange 20, the inner surface 54 thereof has formed therein a pair of shallow grooves 55, 56 extending from the outer surface 13 of barrel 11 to pass beneath, respectively, lugs 25 and 26 to the outer periphery of the flange. Communicating with the outer ends of such grooves are a pair of small notches 57, 58 formed in the periphery of flange 20 and extending axially from such grooves in the side surfaces of the terminal arms 35, 36 to the upper surfaces of those arms.

Figure 4:
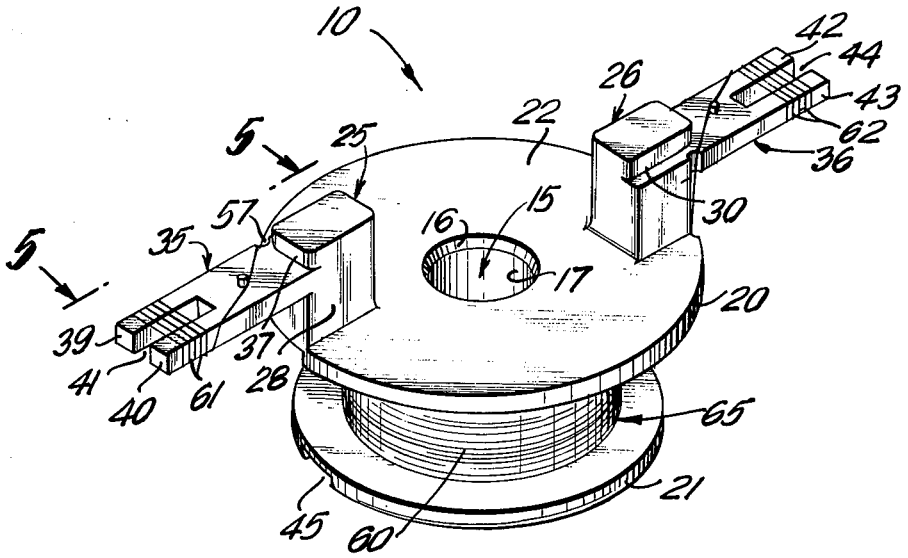
FIG. 4 is an isometric view of the complete inductor coil constituting such embodiment.
Figure 5:
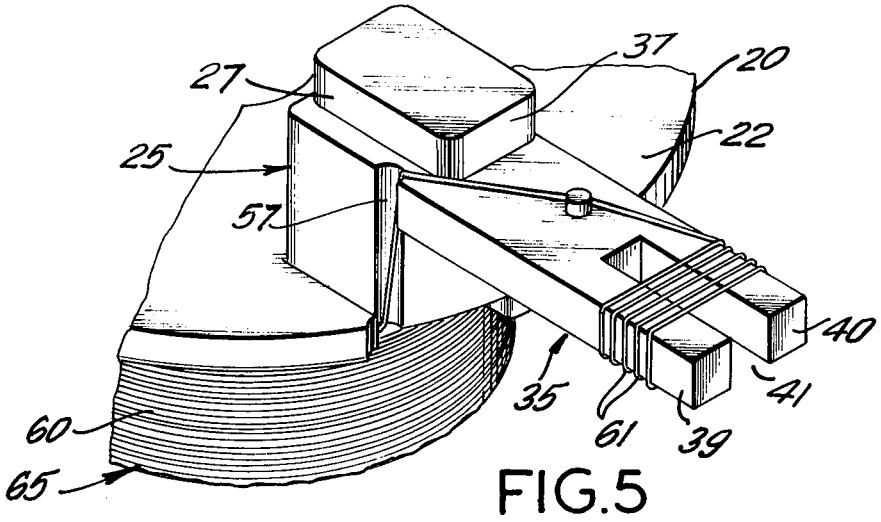
FIG. 5 is an enlarged schematic isometric view of a portion of the FIG. 4 coil, such enlarged view being taken in relation to the FIG. 4 bobbin as indicated by the arrows 4—4 in that figure.

Considering now the complete inductor coil 65, and referring for that purpose particularly to FIGS. 4 and 5, another component of the coil is a segment of insulated electrical wire which may be regarded as divided into a larger central portion and two substantially smaller end lengths. The central portion of such segment is wound around the barrel 11 of bobbin 10 to form a multi-layer multi-turn main winding 60 thereon. Of the two end lengths, one extends radially through groove 55 and axially through notch 57 and diagonally across the upper surface of arm 35 and is then wound around the bifurcated end of that arm to form a multiturn terminal winding 61 spanning the gap 41 between the tines 39 and 40 on the outer end of that arm. The other end length extends similarly through groove 56 and notch 58 and diagonally across arm 36 to form at its bifurcated end a similar terminal winding 62 spanning the gap 44 between the tines 42, 43 at that end. Because arms 35 and 36 extend partly tangentially, the wire which passes through notches 57 and 58 will be retained therein despite the fact those arms have a lesser width than the outer diameter of barrel 11. Windings 61 and 62 constitute two terminal means providing terminal regions on arms 35, 36 for electrically coupling winding 60 to external circuitry.

USE OF THE EMBODIMENT

Figure 6:
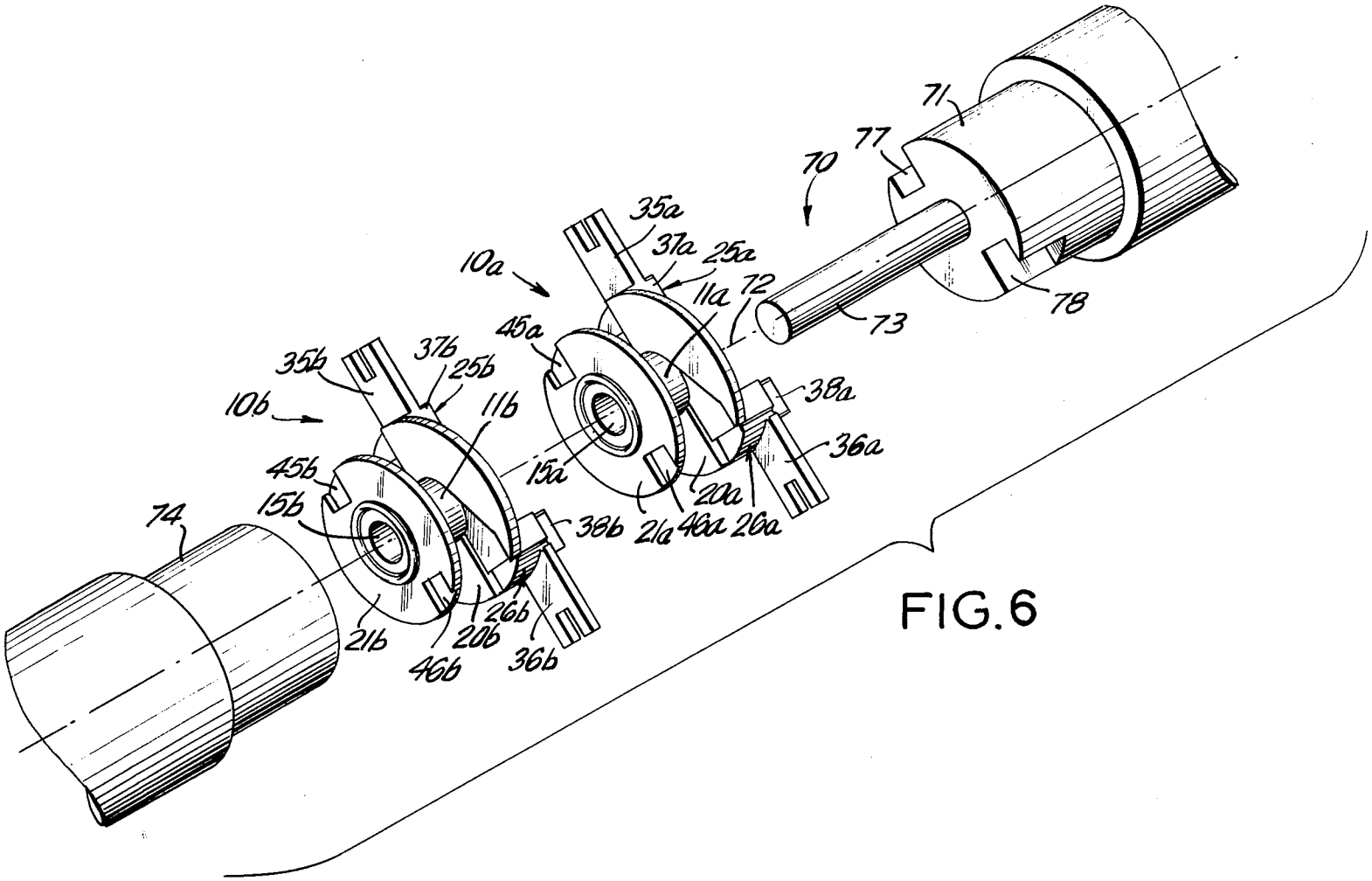
FIG. 6 is an isometric view of an array of FIG. 1 bobbins mounted on a winding machine for purposes of forming windings so as to arrive at complete inductor coils such as the FIG. 4 coil.

Referring to FIG. 6 which shows how the mechanical coupling features of the described inductor coil are used, the reference numeral 70 designates a coil winding machine having a driving head 71 rotatable about its axis 72 by conventional motive means (not shown). Projecting axially forward coaxially from head 71 is a circular, cylindrical spindle 73 fixedly coupled in rotation with that head. The front end of the spindle is adapted to slidably enter into the bore of a freely rotatable passive head 74 which is shiftable along axis 72 towards and away from head 71.

With the heads 71 and 74 being in the positions shown in FIG. 6 so that spindle 73 is retracted from head 74, and with head 71 being stationary, an array of bobbins which are similar to that described above are slid onto the spindle. While such array may consist of a large number of such bobbins, FIG. 6 shows an array consisting of only two bobbins **10*a* and 10*b***.

Spindle 73 has a diameter matched to the bores **15*a*, 15*b* of bobbins 10*a*, 10*b*** to be receivable within such bores with a slip fit in the sense that the bobbins may be axially moved along the spindle or angularly turned in relation thereto with no significant transmission of force or torque occurring between the bobbins and the spindle. The fit between the spindle and the bobbins is, however, close enough that, when the latter are mounted on the former, no significant angular play can occur between the axis of each bobbin and the spindle axis. Moreover, to the extent that there is any such angular play, the amount thereof per bobbin will a fixed amount individual to that bobbin rather than being an amount per bobbin which increases as a function of the number of bobbins in the array.

Head 71 has formed thereon a pair of peripheral notches 77, 78 adapted to receive the tips 37*a*, 38*a* of the lugs on the forward bobbin 10*a*. The bobbins are angularly turned on the stationary spindle so that the notches 77, 78 on the head axially register with those lugs, and the lugs on rear bobbin 10*b* register with the notch recesses 45*a*, 46*a* on the back flange of the front bobbin. Passive head 74 is then axially advanced towards driving head 71 until spindle 73 has entered the bore in the passive head and, further, the two bobbins 10*a*, 10*b* are urged towards head 71 by axial force from head 74 until the lug tips 37*b*, 38*b* of bobbin 10*b* are received in notches 45*a*, 46*a* of bobbin 10*a*, and the lug tips of the bobbin 10*a* are received into the notches 77, 78 of head 71. Once such mechanical couplings of the bobbins with each other and with the driving head 71 have been fully made, the advance of head 74 is stopped at a point where it eliminates axial play between the bobbins and between the foremost bobbin and head 71, or where it even permits some such play as long as such couplings are adequately maintained. Preferably (but not necessarily), however, head 74 continues to press against the bobbin array with some axial force to assure that such couplings will be maintained without any such axial play.

Head 71 is then angularly adjusted until the arms 35*a*, 35*b* have been brought to a predetermined angular position in relation to the winding machine, as, say, the upright position. With head 71 being clamped to hold these arms in that position, the machine causes terminal windings similar to the described winding 61 (FIG. 5) to be formed on those arms from insulated wire, and such wire to then be led from such windings through the axial notches in these arms and through the corresponding grooves in the front flanges of the bobbins in preparation for forming the main windings on the bobbins.

Next, driving head 71 is actuated to rotate and to produce corresponding rotation of spindle 73. Because of the slip fit between the spindle and the bobbins, no significant turning force or torque will be transmitted from the spindle to the bobbins. On the other hand, rotary torque will be transmitted from the head 71 to all of the bobbins in the array by virtue of the coupling of the lugs 25*a*, 26*a* of bobbin 10*a* with the notches 77, 78 in the head and, also the coupling of lugs 25*b*, 26*b* of bobbin 10*b* in the notches 45*a*, 46*a* of bobbin 10*a* (and so on, if additional bobbins are included in the array thereof on spindle 73). By virtue of such torque transmission, all of the bobbins in the array (and, also passive head 71) will be caused to rotate in fixed relation with each other and at the same speed as spindle 73 so that no slip occurs between it and the bobbins, and, hence, no wear or friction occurs of the inner walls of the bobbin bores as a result of such a slippage. With the bobbins being set into rotation as described, the rotary movement thereof is utilized in a well known manner to form on the barrel of each of the bobbins a main winding similar to the described winding 60.

After formation of such main windings has been completed, rotation of head 71 is stopped, and it is angularly adjusted to dispose the arms 36*a*, 36*b* of the bobbins in, say, an upright position. With head 71 being clamped to hold such arms in that position, insulated wire is led from the main windings, through the grooves leading on the inside of the front flanges of the bobbins to those arms, further through the described axial notches in such arms, and diagonally across such arms to the outer ends thereof. Such end lengths of wire are then wound around such outer ends to form terminal windings thereon similar to the described winding 62. Upon completion of such windings the several wires supplied to the bobbins are broken off, the passive head 74 is retracted from head 71 to expose the free end of spindle 73, and the completed inductor coils are separated from each other and then slid off the spindle.

The described mode of forming a plurality of inductor coils similar to coil 65, provides, together with the structure of the bobbins which lends itself to such mode, a number of advantages of which some are as follows. Because the bobbins are not equipped on the inside of their bores with keyways or the like for driving the bobbins in rotation from the spindle, the radial thickness of the bobbin barrels may be made thinner, and bobbin material is thereby conserved. At the same time, the mounting of the bobbins with a slip fit on the described spindle prevents significant angular play of the bobbin axes in relation to a reference datum (which, here, may be taken as the spindle axis 72) and thereby ensures that the main windings of the coils are accurately and uniformly wound on their bobbins. Also, the fact that the spindle rotates with the bobbins (although not transmitting any significant torque thereto) prevents wear and friction on the wall of the bores in the barrels of the bobbins in the course of winding the main windings thereon. The use of the described lugs and recesses on the bobbins to mechanically couple an array of them together for purposes of rotating them in fixed relation together is an expedient which utilizes the least amount of bobbin material to effect such coupling, and which thereby conserves such material. That is the use of such lugs and recesses permits the end flanges of the bobbins to have inner and outer surfaces which, except at such lugs and recesses are planar and normal to the bobbin axis (as is conventional) and axially separated by a flange thickness which is constant and minimal in size. Further, the fact that such lugs and recesses are at the peripheries of the bobbin flanges minimizes the amount of rotary torque applied to the bobbins for a given tangential force applied thereto. Inasmuch as the sides of the lugs and the sides of the recesses which engage each other to transmit torque between bobbins are planar sides lying in planes parallel to each other and to the axis of the bobbins, the contact between such engaging sides is essentially a flat or areal contract, and such engagement does not produce any axial force component tending to urge the bobbins apart. Also, the bobbins may, by such engagement, be angularly aligned around spindle axis 72 with respect to each other to a high degree of accuracy as, for example within one angular degree (1°) of exact alignment. Further, since the engaging planar sides of the lugs and recess extend outward primarily radially, the force transmitted between engaging lugs and recesses is primarily tangential so as to lack a large component (useless for producing torque) normal to the tangential direction. Still further, the providing on each bobbin of a plurality of lugs equiangularly spaced around it, and of a corresponding plurality of equiangularly spaced recesses for receiving lugs, permits the torque producing forces on each bobbin to cancel out so as to exert no significant force on the spindle 73.

After the described inductor coil 65 has been completed as described, it may be electrically coupled to external circuitry in a manner as follows. First, arm 35 is dipped into a solder fountain for a time long enough to remove the insulation from the wire of winding 61 and coat it with solder, but short enough not to degrade the plastic. Then, as part of such circuitry, a metal terminal strip (not shown) having solder on its underside and of a width less than the gap 41 (FIG. 5) is pressed down on terminal winding 61 in centered relation to the gap. Heat is then applied to the upper side of such strip and, in gap 41, to the underside of winding 61 to produce a solder joint between the wire in that winding and the underside of the strip. Another part of such external circuitry in the form of a similar strip is similarly soldered to the terminal winding 62 on arm 36 of coil 65. Since the strips in the course of their soldering overlie portions of the terminal windings 61, 62 which are not underlain by any of the insulating material of the bobbin, none of such material is melted despite the fact it is thermoplastic, and the soldering operation is more efficient because none of such material is present in the soldering region to act as a sink for drawing off heat intended for soldering purposes.

The above described inductor coil embodiments and the described method of forming their windings being exemplary only, it is to be understood that additions thereto, omissions therefrom and modifications thereof can be made without departing from the spirit of the invention. For example, as mentioned previously, the described plastic terminal arms may be replaced by terminal arms in the form of metal inserts and, in such case, the inserts would not be bifurcated at their ends, and the ends lengths of wire extending from the main winding of the coil would be wound around such inserts over their lengths and then soldered thereto. As another example, terminals for the coil can be provided other than by terminal arms supported as discussed by the described two lugs of the coil's bobbin. In such instance, the sole function of the lugs on the bobbins would be to provide mechanical coupling between adjacent bobbins during the winding operation described above, and this can be done with only one lug and one recess per bobbin to thereby further conserve bobbin material and further simplify the bobbin structure. As still another example, the spindle 73 may, if desired, be freely rotatable in relation to head 71. All of the foregoing examples are examples only and are not to be taken as restricting the invention. Still further, the coil may have three or more terminal arms as described of which none, some or all are supported by corresponding lugs salient from the bobbin of the coil.

Accordingly, the invention is not to be considered as limited save as is consonant with the recitals of the following claims.

What is claimed is:

1. An indicator coil comprising:

(a) a bobbin of insulating material including as integral parts thereof; (i) a tubular barrel having a central axis and a substantially circular cylindrical bore extending axially therethrough, and (ii) first and second end flanges disposed around said bore at axially opposite ends of said barrel and extending radially outward therefrom;

(b) at least two lugs axially projecting outward of said first flange and spaced thereon angularly from each other and radially from said axis;

(c) at least two elongated arms each coupled at one end with a respective one of said lugs at an intermediate point in the axial length thereof such that said lugs have tips projecting axially outward of said arms, said arms being supported as cantilevers by said lugs to extend radially outward therefrom beyond the periphery of said first flange;

(d) at least two recesses formed in the radially extending outer face of said second flange, said recesses having the same angular spacing from each other and radially spacing from said axis as characterizes said lugs, and said recesses being shaped to receive therein the tips of similar lugs of a similar inductor coil disposed coaxially adjacent the coil described hereby;

(e) at least one winding of insulated wire on said barrel; and (f) at least two terminal means providing respective terminal regions disposed on said arms radially outward of said first flange and adapted to electrically couple said winding to external circuitry.

2. An inductor coil according to claim 1 in which said lugs and said cantilever arms are integral with, and of the same material as, said bobbin.

3. An inductor coil according to claim 2 in which said terminal regions on said cantilever arms are provided by end windings thereon disposed radially outward of the periphery of said first flange and each constituted of an end length of a segment of insulated wire of which the central portion of said segment forms said main winding.

4. An inductor coil according to claim 3 in which said bobbin, lug and cantilever arms are constituted of thermoplastic insulating material, the free end of each of said arms has formed therein a notch extending radially inward from such end to render bifurcated the outer portion of such arm, and in which the end winding on such arm is wound around such bifurcated portion to span the gap between the two tines of such portion.

5. An inductor coil according to claim 1 in which said first and second end flanges each have planar radially extending inner and outer faces separated by a substantially constant axial thickness of the flange, and in which said recesses in said second flange extend axially inward from its outer face by less than the axial thickness of such flange.

6. An inductor coil comprising:

(a) a bobbin of insulating material including as integral parts thereof;

(i) a tubular barrel having a central axis and a substantially circular cylindrical bore extending axially therethrough, and (ii) first and second end flanges disposed around said bore at axially opposite ends of said barrel and extending radially outward therefrom, (b) at least one lug integral with and axially projecting outward of said first flange;

(c) at least one recess formed in the radially extended outer face of said second flange and extending axially inward from such face by less than the axial thickness of such flange to form an indentation in such face, said recess having the same radial spacing from said axis as characterizes said lug, and said lug and recess being mutually shaped to permit said recess to receive therein a similar lug of a similar inductor coil disposed coaxially adjacent the coil described hereby and to engage such received lug so as to transmit therebetween tangential force free of any substantial axial force component directed to urge such coils apart;

(d) at least one winding of insulated wire on said barrel; and (e) at least two terminal means carried by said bobbin and adapted to electrically couple said main winding to external circuitry.

* * * * *